US008558441B2

(12) United States Patent
Nakano et al.

(10) Patent No.: US 8,558,441 B2
(45) Date of Patent: Oct. 15, 2013

(54) PLASMA JET IGNITION PLUG

(75) Inventors: Daisuke Nakano, Kiyosu (JP); Yoshikuni Sato, Nagoya (JP); Hiroyuki Kameda, Aichi-ken (JP); Naohumi Yamamura, Nagoya (JP); Daisuke Kasahara, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 808 days.

(21) Appl. No.: 12/749,656

(22) Filed: Mar. 30, 2010

(65) Prior Publication Data

US 2010/0259172 A1 Oct. 14, 2010

(30) Foreign Application Priority Data

Mar. 31, 2009 (JP) ..... 2009-086425
Mar. 16, 2010 (JP) ..... 2010-059396

(51) Int. Cl.
*H01T 13/20* (2006.01)

(52) U.S. Cl.
USPC ..... 313/141; 313/118

(58) Field of Classification Search
USPC ..... 313/118–145
See application file for complete search history.

(56) References Cited

U.S. PATENT DOCUMENTS

| | | | | |
|---|---|---|---|---|
| 3,871,349 | A | 3/1975 | Hager | 123/169 |
| 4,317,068 | A | 2/1982 | Ward et al. | 315/209 |
| 4,774,914 | A | 10/1988 | Ward | 123/162 |
| 4,841,925 | A | 6/1989 | Ward | 123/143 |
| 6,321,733 | B1 | 11/2001 | Suckewer et al. | 123/620 |
| 6,679,235 | B1 | 1/2004 | Skinner et al. | 123/620 |
| 2007/0221157 | A1 * | 9/2007 | Hagiwara et al. | 123/143 B |
| 2008/0121200 | A1 | 5/2008 | Kato et al. | 123/143 |

FOREIGN PATENT DOCUMENTS

| | | |
|---|---|---|
| GB | 444439 | 3/1936 |
| JP | 55-77981 U | 1/1982 |
| JP | 57-028869 | 2/1982 |
| JP | 2002-327672 | 11/2002 |

OTHER PUBLICATIONS

Extended European Search Report for corresponding European Patent Application No. 10158481.1, dated Aug. 24, 2010.
Notification of Reasons for Refusal (dated Feb. 1, 2011) issued in connection with corresponding Japanese Patent Application No. 2010-059396, with English translation.

* cited by examiner

*Primary Examiner* — Anh Mai
*Assistant Examiner* — Andrew Coughlin
(74) *Attorney, Agent, or Firm* — Kusner & Jaffe

(57) ABSTRACT

A plasma jet ignition plug including a wire-wound resistor for restraining the radiation of noise while allowing application of a sufficiently large current for generation of plasma to a spark discharge gap at the time of ignition. The wire-wound resistor having an inductance of 1 μH to 100 μH inclusive and a resistance of 1Ω or less, and is provided on at least one of a center electrode and a ground electrode. The wire-wound resistor restrains current which is generated by the influence of stray capacitance present in the plasma jet ignition plug, thereby reducing noise.

3 Claims, 9 Drawing Sheets

PLASMA JET IGNITION PLUG

FIELD OF THE INVENTION

The present invention relates to a plasma jet ignition plug for an internal combustion engine adapted to generate plasma and ignite an air-fuel mixture by means of the plasma.

BACKGROUND OF THE INVENTION

Conventionally, a spark plug has been used to ignite an air-fuel mixture through spark discharge (which may be referred to merely as "discharge") for operation of an engine, such as an internal combustion engine for an automobile. In recent years, high output and low fuel consumption have been required of internal combustion engines. To fulfill such requirements, use of a plasma jet ignition plug is known, since the plasma jet ignition plug provides quick propagation of combustion and exhibits such high ignition performance as to be capable of reliably igniting even a lean air-fuel mixture having a higher ignition-limit air-fuel ratio.

When such a plasma jet ignition plug is used while being connected to a power supply, a spark discharge gap is formed between a center electrode and a ground electrode. The plasma jet ignition plug has a structure in which an insulator formed from ceramics or the like surrounds the spark discharge gap, thereby forming a small-volume discharge space called a cavity. A plasma jet ignition plug used with a superposition-type power supply (refer to, for example, Japanese Patent Application Laid-Open (kokai) No. 2002-327672) is described by way of example. For ignition of an air-fuel mixture, first, high voltage is applied between the center electrode and the ground electrode, thereby generating spark discharge (also called "trigger discharge"). By virtue of associated occurrence of dielectric breakdown, current can be applied between the center electrode and the ground electrode with a relatively low voltage. Thus, through transition of a discharge state effected by further supply of energy, plasma is generated within the cavity. The generated plasma is jetted out through a communication hole (a so-called orifice), thereby igniting the air-fuel mixture. This process corresponds to a single cycle of jetting-out of plasma.

In generation of plasma, such a plasma jet ignition plug requires application, to the spark discharge gap, of current greater than that applied for generation of spark discharge in an ordinary spark plug. In order to increase current to be applied, electric resistance of a circuit through which the current flows must be lowered. Thus, there has not been an idea of providing a resistor in the interior of a plasma jet ignition plug (refer to, for example, Japanese Patent Application Laid-Open (kokai) No. 57-28869).

SUMMARY OF THE INVENTION

Problems To Be Solved By the Invention

Since large current is applied to a plasma jet ignition plug in a short period of time, fluctuations in current per unit time are great. Thus, at the time of capacitive discharge, a plasma jet ignition plug having no resistor involves great erosion of an insulator and an electrode caused by capacitive discharge, as well as generation of electric noise (in the present specification, electromagnetic waves radiated to the exterior of equipment or like noise may be called "electric noise"; the flow of high-frequency current in electronic equipment induces the radiation of electric noise, which has an interference effect on external equipment and other signals). Meanwhile, in order to restrain erosion of the insulator and the electrode caused by capacitive discharge, and generation of great electric noise at the time of capacitive discharge, it is conceived to restrain current flowing to the plasma jet ignition plug. However, as a result of reduction in discharge current to be generated at the time of capacitive discharge, energy associated with capacitive discharge may fail to be sufficient for generation of plasma. In this manner, a trade-off relation exists between, on the one hand, generation of capacitive discharge of sufficient magnitude for generation of plasma, and on the other hand, restraining erosion of the insulator and the electrode caused by capacitive discharge and generation of great electric noise at the time of capacitive discharge. A plasma jet ignition plug which has an optimum structure under the limitation of this trade-off relation is sought.

The present invention has been conceived in view of the above circumstances, and an object of the invention is to provide a plasma jet ignition plug which can restrain generation of electric noise while allowing application of sufficiently large current for generation of plasma to a spark discharge gap at the time of ignition.

Means for Solving the Problems

To achieve the above-mentioned object, the present invention provides a plasma jet ignition plug as configured below in (1) to (3).

(1) A plasma jet ignition plug comprises an insulator having an axial hole extending in an axial direction; a center electrode disposed within the axial hole such that a front end is located rearward of a front end of the insulator with respect to the axial direction; a substantially tubular metallic shell disposed radially outward of the insulator; and a ground electrode defining a spark discharge gap in cooperation with the center electrode. The plasma jet ignition plug is characterized in that a resistor having an inductance of 1 μH to 100 μH inclusive and a resistance of 1Ω or less is electrically connected to at least one of the center electrode and the ground electrode.

(2) In a plasma jet ignition plug configured as mentioned above in (1), the resistor is provided while being connected to a rear end portion of the center electrode.

(3) In a plasma jet ignition plug configured as mentioned above in (1), the resistor is provided such that one end of the resistor is connected to the ground electrode, and the other end of the resistor is connected to the metallic shell.

The plasma jet ignition plug configured as mentioned above in (1) can restrain generation of electric noise while allowing application of sufficiently large current for generation of plasma to a spark discharge gap at the time of ignition by the plasma jet ignition plug.

A certain spark plug, which does not consider ignition of an air-fuel mixture by means of plasma as practiced in a plasma jet ignition plug, has a resistor having a resistance of several kΩ to several tens of kΩ. Conventionally, there is no idea of providing a resistor in the interior of a plasma jet ignition plug. Thus, an idea of applying a resistor used in a spark plug to a plasma jet ignition plug is not probable. Even if a resistor used in a spark plug is applied to a plasma jet ignition plug, the resistor to which excessively high resistance is imparted without consideration of ignition of an air-fuel mixture by means of plasma causes a failure to apply sufficiently large current for generation of plasma to a spark discharge gap. As a result, ignition of an air-fuel mixture by means of plasma fails.

The plasma jet ignition plug configured as mentioned above in (2) or (3) allows provision of a resistor by a simple structure.

Effect of the Invention

The plasma jet ignition plug of the present invention can restrain generation of electric noise while allowing application of sufficiently large current for generation of plasma to a spark discharge gap at the time of ignition by the plasma jet ignition plug.

The present invention has been summarized above. The details of the present invention will be clarified by the following detailed description and with reference to the appended drawings.

BRIEF DESCRIPTION OF THE DRAWINGS

FIGS. 6A and 6B are views showing, on an enlarged scale, a portion of a plasma jet ignition plug according to Modification 1, wherein FIG. 6A is a partial, sectional view, and FIG. 6B is a top view.

FIGS. 8A and 8B are views showing, on an enlarged scale, a portion of a plasma jet ignition plug according to Modification 2, wherein FIG. 8A is a partial, sectional view, and FIG. 8B is a top view.

DETAILED DESCRIPTION OF THE INVENTION

Figure 1:
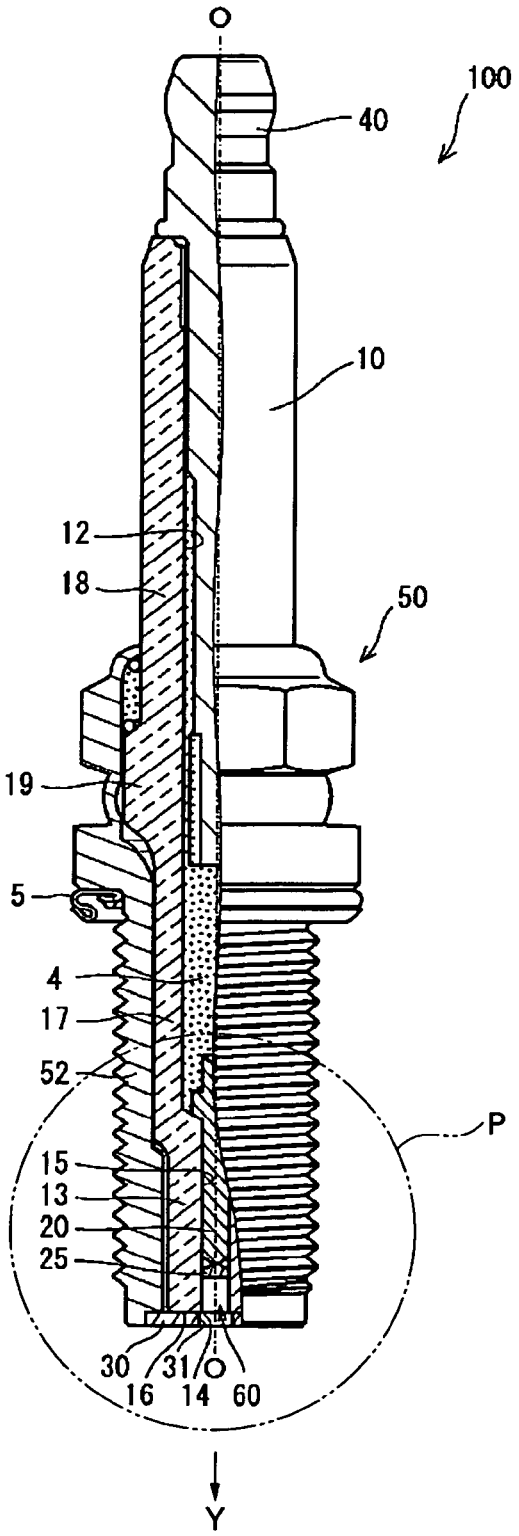
FIG. 1 is a partially sectional view showing the basic configuration of a plasma jet ignition plug.

A plasma jet ignition plug according to an embodiment of the present invention will be described with reference to the drawings. FIG. 1 shows the basic configuration of a plasma jet ignition plug 100 of the present invention. In the following description, an axial direction O of the plasma jet ignition plug 100 in FIG. 1 is referred to as the vertical direction, and the lower side of the plasma jet ignition plug 100 in FIG. 1 is referred to as the front side of the plasma jet ignition plug 100, and the upper side as the rear side of the plasma jet ignition plug 100.

The plasma jet ignition plug 100 shown in FIG. 1 has a tubular insulator 10. As is well known, the insulator 10 is an electrically insulative member formed from alumina or the like by firing and has an axial hole 12 extending in an axial direction O. The insulator 10 has an intermediate trunk portion 19 formed substantially at the center with respect to the axial direction O and having the greatest outside diameter. The insulator 10 also has a rear trunk portion 18 located rearward of the intermediate trunk portion 19, having an outside diameter smaller than that of the intermediate trunk portion 19, and extending rearward (upward in FIG. 1) along the axial direction O. The insulator 10 further has a front trunk portion 17 located frontward (downward in FIG. 1) of the intermediate trunk portion 19 and having an outside diameter smaller than that of the rear trunk portion 18. Further, the insulator 10 has a leg portion 13 located frontward of the front trunk portion 17 and having an outside diameter smaller than that of the front trunk portion 17. A portion of the axial hole 12 of the insulator 10 which corresponds to the leg portion 13 is smaller in diameter than the remaining portion of the axial hole 12 and serves as an electrode-accommodating portion 15. The electrode-accommodating portion 15 extends to a front end surface 16 of the insulator 10 and forms an opening portion 14 of a cavity 60, which will be described later, at the front end surface 16.

A rodlike center electrode 20 is inserted into the electrode-accommodating portion 15 of the axial hole 12. The center electrode 20 has a core of copper or a copper alloy and an outer layer of an Ni alloy. Alternatively, the center electrode 20 may be configured such that a disklike electrode chip 25 formed from an alloy which predominantly contains a noble metal or tungsten (W) is joined to the front end of the center electrode 20 (in the present embodiment, the entirety of the center electrode 20 and the electrode chip 25 joined to each other is referred to as the "center electrode"). The center electrode 20 is disposed in the electrode-accommodating portion 15 such that the front end thereof (or the front end of the electrode chip 25 joined to the center electrode 20) is located rearward of the front end surface 16 of the leg portion 13 of the insulator 10 with respect to the axial direction. Thus, the front end of the center electrode 20 and the wall of the electrode-accommodating portion 15 of the axial hole 12 define a discharge space having a small volume. In the present embodiment, the discharge space is called the cavity 60. The center electrode 20 extends rearward in the axial hole 12 and is electrically connected to a metal terminal 40 provided at a rear end portion of the axial hole 12, via a wire-wound resistor 21, which will be described later, and an electrically conductive seal body 4 formed from a metal-glass mixture. A high-tension cable (not shown) is connected to the metal terminal 40 via a plug cap (not shown) for application of high voltage from an ignition system 200 (see FIG. 3), which will be described later.

The insulator 10 is held through crimping in a metallic shell 50 formed substantially cylindrically by use of an iron-based material, such that a region extending from a portion of the rear trunk portion 18 to the leg portion 13 is surrounded by the metallic shell 50. The metallic shell 50 disposed in such a manner as to surround the insulator 10 is adapted to fix the plasma jet ignition plug 100 to the engine head of an internal combustion engine and has a mounting threaded portion 52 having threads to be threadingly engaged with a mounting hole of the engine head. An annular gasket 5 is fitted to the metallic shell 50 at the proximal end of the mounting threaded portion 52 in order to prevent gas leakage from inside the engine through the mounting hole.

A disklike ground electrode 30 is provided at the front end of the metallic shell 50. The ground electrode 30 is formed from an Ni alloy having excellent resistance to spark-induced erosion, such as INCONEL 600 or 601 (trademark). The ground electrode 30 is joined to the metallic shell 50 while being in contact with the front end surface 16 of the insulator 10, with its thickness direction coinciding with the axial direction O. The ground electrode 30 has a communication hole 31 formed at the center thereof. The communication hole 31 is coaxially continuous with the opening portion 14 of the cavity 60, whereby the cavity 60 communicates with the ambient atmosphere through the communication hole 31. A spark discharge gap is formed between the ground electrode 30 and the center electrode 20. The cavity 60 encompasses at least a portion of the spark discharge gap. At the time of spark discharge generated across the spark discharge gap, energy is supplied, thereby forming plasma within the cavity 60. The plasma is jetted out from the opening portion 14 through the communication hole 31.

Figure 2:
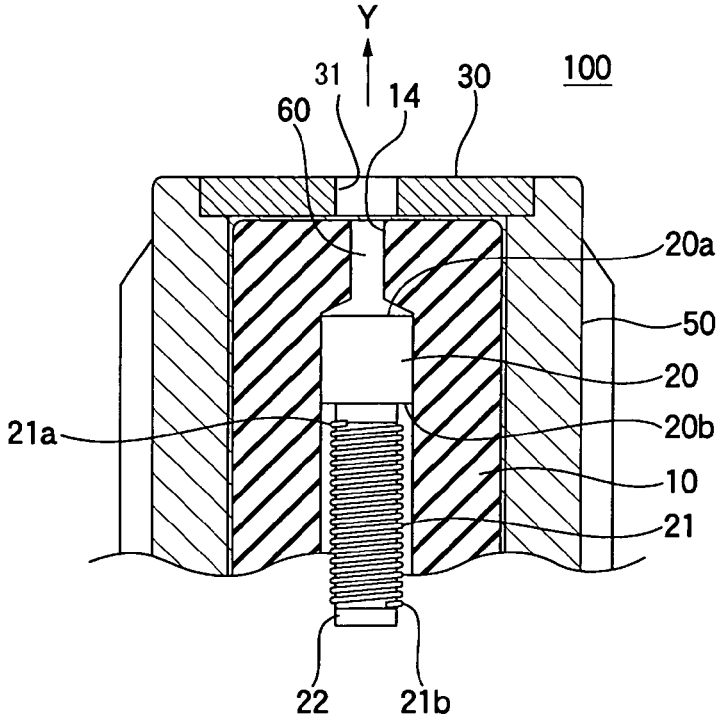
FIG. 2 is a partial, sectional view showing, on an enlarged scale, a portion of the plasma jet ignition plug shown in FIG. 1.

FIG. 2 shows the detail of a front end portion (a region P surrounded by the imaginary line in FIG. 1) of the plasma jet ignition plug 100 shown in FIG. 1. Notably, the vertical direction is reversed between FIGS. 1 and 2. The arrow Y indicates the frontward direction of the plasma jet ignition plug 100. The downward direction in FIG. 1 corresponds to the upward direction in FIG. 2.

As shown in FIG. 2, the center electrode 20 is disposed in a space surrounded by the insulator 10. A circular columnar bobbin 22 formed from an insulation material is connected to the rear end (lower end in FIG. 2) of the center electrode 20. A wire (metal or the like) formed from a material having a constant resistivity is wound onto the bobbin 22 in a spiral (coiled) manner, thereby forming the wire-wound resistor 21.

One end 21*a* of the wire-wound resistor 21 is electrically connected to one end 20*b* of the center electrode 20, and the other end 21*b* of the wire-wound resistor 21 is electrically connected to the metal terminal 40 via the seal member 4 shown in FIG. 1. The wire-wound resistor 21 electrically includes a direct-current resistance component and an inductance component. In the present embodiment, the thickness and the number of turns of the wire-wound resistor 21 are determined such that the wire-wound resistor 21 has a direct-current resistance of 1Ω or less and an inductance of 1 μH to 100 μH inclusive (the reason for selecting the values is described in detail below). The value of direct-current resistance and the value of inductance have been determined based on the results of the test in which the inventors of the present invention repeated measurement while the direct-current resistance and the inductance were varied, so as to be favorable for achieving the object of the present invention; i.e., for restraining, by means of the wire-wound resistor 21, current which is generated by the influence of stray capacitance present in a plasma jet ignition plug, thereby reducing noise. When the resistance of the wire-wound resistor 21 is in excess of 1Ω, a limitation is imposed on current derived from charges stored in a capacitor C (current for generation of plasma; may be referred to as plasma current), resulting in a failure to efficiently supply sufficient energy for generation of plasma to the spark discharge gap (deterioration in ignition performance of the plasma jet ignition plug 100). When the inductance of the wire-wound resistor 21 is less than 1 μH, capacitive discharge current cannot be reduced sufficiently, resulting in a failure to yield sufficient effects in terms of reduction in noise at the time of capacitive discharge and restraint of erosion of the insulator (a deterioration in the magnitude of reduction in noise).

An electrode which surrounds the center electrode 20 is composed of the ground electrode 30 and the metallic shell 50. The ground electrode 30 and the metallic shell 50 are electrically connected to each other and grounded. The insulator 10 electrically insulates the center electrode 20 from the ground electrode 30 and the metallic shell 50.

At the front end of the plasma jet ignition plug 100, the communication hole 31 is formed at a central portion of the ground electrode 30. The cavity 60 is formed between the communication hole 31 and one end 20*a* of the center electrode 20 and serves as a space for discharge. When high voltage is applied between the center electrode 20 and the ground electrode 30, a spark discharge is generated in the cavity 60 while being accompanied by dielectric breakdown. Through supply of great electric energy subsequent to generation of spark discharge, plasma is generated through discharge. The plasma is discharged from the communication hole 31 in a columnar form in the direction of the arrow Y and ignites an air-fuel mixture.

Figure 3:
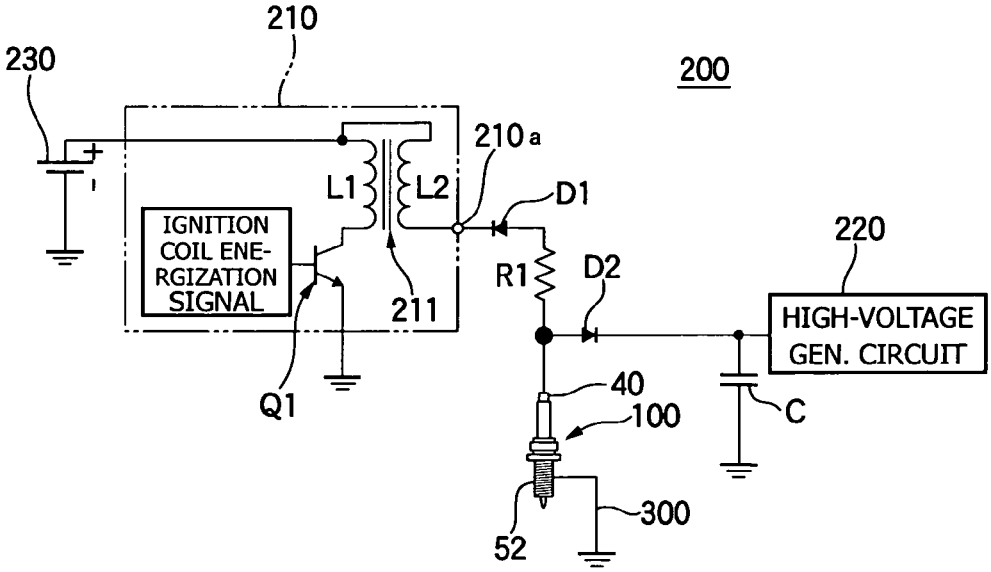
FIG. 3 is an electric circuit diagram showing an example configuration of an ignition system which uses the plasma jet ignition plug shown in FIG. 2.

FIG. 3 shows an example configuration of an electric circuit of an ignition system 200 which uses the plasma jet ignition plug 100 shown in FIGS. 1 and 2. As shown in FIG. 3, the ignition system 200 has two high-voltage generation circuits 210 and 220. The high-voltage generation circuit 210 is a power supply for generating spark discharges between the center electrode 20 and the ground electrode 30 of the plasma jet ignition plug 100 and transiently outputs a high voltage on the order of tens of kV. The other high-voltage generation circuit 220 is a power supply for supplying electric energy necessary for generation of plasma to the plasma jet ignition plug 100 after the spark discharge and outputs a high voltage of about 500 V. By virtue of electric power supplied from the high-voltage generation circuit 210 and electric power supplied from the high-voltage generation circuit 220, plasma is jetted out into an internal space of an engine head from the opening portion (the communication hole 31) of the plasma jet ignition plug 100 and ignites an air-fuel mixture.

The high-voltage generation circuit 210 shown in FIG. 3 has an ignition coil 211 and a transistor Q1. The ignition coil 211 is a high-voltage transformer having a primary winding L1 and a secondary winding L2. The primary winding L1 of the ignition coil 211 is connected at one end to the plus terminal of a direct-current power supply (battery or the like) 230 and at the other end to the collector terminal of the transistor Q1. The minus terminal of the direct-current power supply 230 is grounded.

An unillustrated control circuit applies an ignition-coil energization signal to the base electrode, which serves as a control terminal, of the transistor Q1. The ignition-coil energization signal is a binary signal in which a pulse signal emerges once every discharge cycle in the plasma jet ignition plug 100, and is utilized for switching control of the transistor Q1.

Specifically, when the ignition-coil energization signal becomes a high level, the transistor Q1 becomes conductive, and electric power supplied from the direct-current power supply 230 causes current to flow through the primary winding L1 of the ignition coil 211. When the ignition-coil energization signal becomes a low level, the transistor Q1 is switched to a nonconductive state, and current flowing through the primary winding L1 of the ignition coil 211 is shut off rapidly. When current starts to flow through the primary winding L1 of the ignition coil 211 and when current flowing through the primary winding L1 of the ignition coil 211 is shut off, high voltage is generated across the secondary winding L2. Voltage to be generated across the secondary winding L2 depends on the turns ratio between the primary winding L1 and the secondary winding L2.

As shown in FIG. 3, an output terminal 210*a* of the high-voltage generation circuit 210 is connected to the cathode terminal of a diode D1; one end of a resistor R1 is connected to the anode terminal of the diode D1; and the other end of the resistor R1 is electrically connected to the metal terminal 40 of the plasma jet ignition plug 100. The diode D1 is provided to prevent reverse flow of current. That is, the diode D1 controls polarity such that voltage of negative polarity causes current at the time of spark discharge to flow only in a direction from the metal terminal 40 to the secondary winding L2. Desirably, the resistor R1 has a resistance of 100Ω or greater.

Meanwhile, a capacitor C is connected between the ground and the output terminal of the high-voltage generation circuit 220. The cathode terminal of a diode D2 is connected to the output terminal of the high-voltage generation circuit 220. The anode terminal of the diode D2 is electrically connected to the metal terminal 40 of the plasma jet ignition plug 100. The diode D2 is provided to prevent reverse flow of current. That is, the diode D2 controls polarity such that voltage of negative polarity causes current at the time of plasma discharge to flow only in a direction from the metal terminal 40 toward the output terminal of the high-voltage generation circuit 220.

When discharge is to be started in the plasma jet ignition plug 100, first, in order to generate a spark discharge (also called trigger discharge), the high-voltage generation circuit 210 supplies high voltage to the plasma jet ignition plug 100. Specifically, when the transistor Q1 shown in FIG. 3 is switched from a conductive state to a nonconductive state, high voltage is generated instantaneously across the secondary winding L2 of the ignition coil 211. The high voltage emerges at the output terminal 210*a* of the high-voltage generation circuit 210 in the form of voltage of negative polarity to the ground potential. The high voltage is applied to the metal terminal 40 of the plasma jet ignition plug 100 via the diode D1 and the resistor R1.

Meanwhile, stray capacitances are present between inner electrodes of the plasma jet ignition plug 100, between the ground and a high-tension cable (a conductor line including D1 and R1) connecting the high-voltage generation circuit 210 and the plasma jet ignition plug 100, and between the ground and the secondary winding L2 of the ignition coil 211.

When high voltage emerges instantaneously at the output terminal 210*a* of the high-voltage generation circuit 210, the high voltage causes storage of charges in the above-mentioned stray capacitances. At the initial stage of discharge (called "capacitive discharge"; in several nanoseconds) in the plasma jet ignition plug 100, high voltage causes the occurrence of dielectric breakdown and the associated generation of spark discharge in the cavity 60. At this time, charges stored in the stray capacitances are released, thereby supplying electric energy to the plasma jet ignition plug 100. After release of charges from the stray capacitances (called "inductive discharge"; in several microseconds), energy stored in inductance of the secondary winding L2 of the ignition coil 211 is released, so that discharge continues.

Meanwhile, in order to generate plasma through discharge, large electric energy must be supplied to the plasma jet ignition plug 100. Since current which the high-voltage generation circuit 210 can supply to the plasma jet ignition plug 100 is relatively small, energy for generating plasma is supplied from the separate high-voltage generation circuit 220. In actuality, electric power output from the high-voltage generation circuit 220 is stored in the capacitor C, and charges stored in the capacitor C are supplied to the plasma jet ignition plug 100 via the diode D2. When plasma discharge is to be performed after spark discharge, discharge can be continued with a relatively low voltage, since the occurrence of dielectric breakdown at the time of spark discharge establishes a condition for easy occurrence of discharge.

In actuality, when voltage of negative polarity which the high-voltage generation circuit 210 applies to the metal terminal 40 of the plasma jet ignition plug 100 becomes lower than voltage of negative polarity which emerges between the terminals of the capacitor C connected to the high-voltage generation circuit 220, the diode D2 becomes conductive. Thus, charges stored in the capacitor C are supplied to the plasma jet ignition plug 100 via the diode D2. That is, current which flows in association with plasma generated in the cavity 60 of the plasma jet ignition plug 100 (called plasma current) flows from the metal terminal 40 to the capacitor C via the diode D2. Accordingly, the plasma current starts to flow in the midst of the timing of "capacitive discharge" and continues to flow according to the amount of charges stored in the capacitor C.

The capacitance of the capacitor C is set such that sufficient energy is supplied for generation of plasma; i.e., such that the sum of the amount of energy supplied from stray capacitances to the spark discharge gap at the time of trigger discharge and the amount of energy supplied from the capacitor C becomes the amount of energy required for single jetting-out of plasma (e.g., 150 mJ). Through supply of these energies, plasma can be jetted out from the opening portion (the communication hole 31) in the form of a pillar of fire (in the form of flame), whereby the plasma can ignite an air-fuel mixture.

Figure 5:
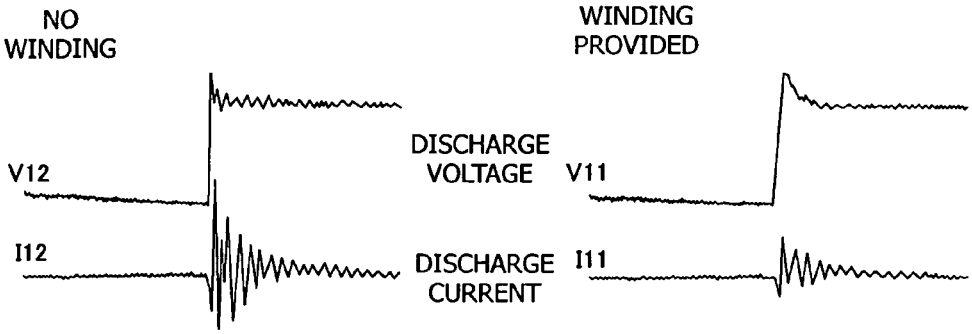
FIG. 5 is a waveform diagram showing specific examples of waveforms of discharge current and discharge voltage applied to plasma jet ignition plugs.

Meanwhile, at the timing of the aforementioned "capacitive discharge," charges of high voltage cause emergence of high-frequency current having a large amplitude in the waveform of discharge current in a very short period of time (e.g., waveform of I12 in FIG. 5). When the high-frequency current radiates noise, such as electromagnetic waves, the radiated noise has adverse effect on electronic equipment and the like disposed around the ignition system 200. Thus, noise radiated from the ignition system 200 must be reduced.

In the ignition system 200 having a configuration shown in FIG. 3, as the aforementioned stray capacitances and the discharge voltage increase, current associated with "capacitive discharge" increases, so that the intensity of radiated noise also increases. Also, as direct-current resistance present in a path through which current associated with "capacitive discharge" flows reduces, the current associated with "capacitive discharge" increases, so that the intensity of radiated noise also increases.

Meanwhile, when current associated with "capacitive discharge" is small, difficulty is encountered in applying plasma current to the plasma jet ignition plug 100 at the time of plasma discharge. Specifically, when current associated with "capacitive discharge" is small, the release of stored charges from the aforementioned stray capacitances consumes a long time, thereby elongating time for attenuation of high voltage of negative polarity applied from the high-voltage generation circuit 210 to the plasma jet ignition plug 100. The diode D2 does not become conductive unless the high voltage attenuates sufficiently. Thus, charges stored in the capacitor C cannot be supplied to the plasma jet ignition plug 100 for initiation of plasma discharge.

As for a line through which plasma current flows (a current path in which the diode D2 and the like are present), reducing direct-current resistance is desirable. The reduction of direct-current resistance increases the peak value of plasma current, thereby improving plasma generation efficiency.

By means of the resistor R1 being inserted between the output terminal 210*a* of the high-voltage generation circuit 210 and the metal terminal 40 of the plasma jet ignition plug 100 as shown in FIG. 3, noise can be reduced. Specifically, at the time of "capacitive discharge," by means of elongating discharge time through restraint of current derived from charges stored in stray capacitances which are present between the ground and the high-tension cable (the conductor line including D1 and R1) connecting the high-voltage generation circuit 210 and the plasma jet ignition plug 100 and between the ground and the secondary winding L2 of the ignition coil 211, the amplitude of high-frequency current is reduced, whereby radiated noise is reduced.

Since there is no need to cause current to flow between the output terminal 210*a* of the high-voltage generation circuit 210 and the metal terminal 40 of the plasma jet ignition plug 100, the resistor R1 having a relatively large resistance (100Ω or higher) can be inserted into the current path.

However, stray capacitances which influence current associated with "capacitive discharge" are not limited to those which are present between the ground and the high-tension cable (the conductor line including D1 and R1) connecting the high-voltage generation circuit 210 and the plasma jet ignition plug 100 and between the ground and the secondary winding L2 of the ignition coil 211; other stray capacitances also exist. Therefore, mere insertion of the resistor R1 fails to reduce noise sufficiently.

Figure 4:
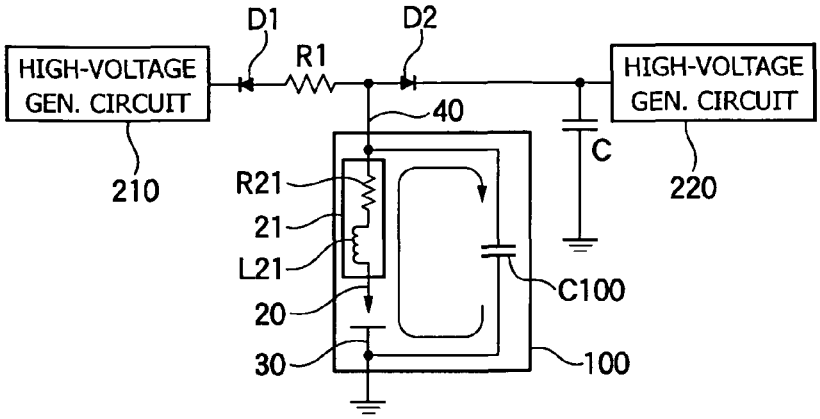
FIG. 4 is an electric circuit diagram showing the circuit configuration of an ignition system which includes an equivalent circuit of the interior of the plasma jet ignition plug shown in FIG. 2.

FIG. 4 shows an equivalent circuit of a portion of the ignition system 200 shown in FIG. 3. As shown in FIG. 4, a stray capacitance C100 is present between electrodes of the plasma jet ignition plug 100; i.e., between the metal terminal 40 and the center electrode 20, and the ground electrode 30 and the metallic shell 50, which are on the ground side. Since current derived from charges stored in the stray capacitance C100 does not flow through the path in which the resistor R1 is present, mere insertion of the resistor R1 fails to restrain the current derived from the stray capacitance C100, potentially resulting in generation of great noise.

The wire-wound resistor 21 incorporated in the plasma jet ignition plug 100 is useful for controlling current derived from the stray capacitance C100. Specifically, since the wire-wound resistor 21 has a direct-current resistance component R21 and an inductance component L21, current which is derived from the stray capacitance C100 and flows at the time of "capacitive discharge" is restrained, and the period of time when current flows is adjusted.

Figure 12:
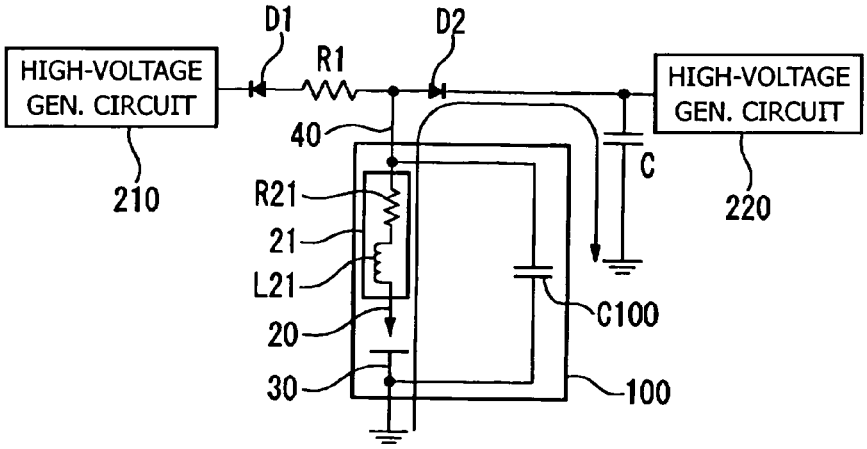
FIG. 12 is an electric circuit diagram showing the circuit configuration of an ignition system which includes an equivalent circuit of the interior of the plasma jet ignition plug shown in FIG. 2.
Figure 13:
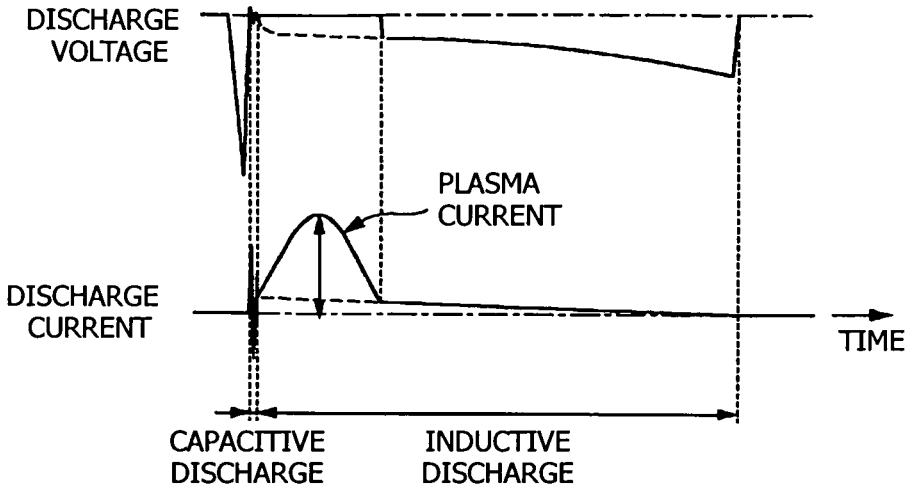
FIG. 13 is a waveform diagram showing specific examples of waveforms of discharge current and discharge voltage applied to a plasma jet ignition plug.

Now, the reason for forming the wire-wound resistor 21 to have a direct-current resistance of 1Ω or less and an inductance of 1 μH to 100 μH inclusive will be described with reference to FIGS. 4, 12, and 13.

At the time of capacitive discharge, as shown in FIG. 4, capacitive discharge current which flows through a closed circuit including the stray capacitance C100 flows through the wire-wound resistor 21. Also, at the time of inductive discharge, as shown in FIG. 12, plasma current which flows from the ground electrode 30 toward the capacitor C flows through the wire-wound resistor 21. The peak value of plasma current shown in FIG. 13 varies depending on the values of the direct-current resistance component R21 and the inductance component L21 of the wire-wound resistor 21. The smaller the values of the direct-current resistance component R21 and the inductance component L21, the greater the peak value. The greater the values of the direct-current resistance component R21 and the inductance component L21, the smaller the peak value. Meanwhile, in order for the plasma jet ignition plug 100 to exhibit good ignition performance, plasma generated in the cavity must be jetted out strongly through the communication hole (orifice). The intensity of jetting-out of plasma depends on the peak value of plasma current. The greater the peak value of plasma current, the higher the intensity. Therefore, the direct-current resistance component R21 and the inductance component L21 of the wire-wound resistor 21 must be determined in consideration of ignition performance of the plasma jet ignition plug 100.

The inventors of the present invention examined the relationship between the values of the direct-resistance component R21 and the inductance component L21, and the degree of reduction in noise caused by current derived from the stray capacitance C100 and the ignition performance of the plasma jet ignition plug 100. Table 1 shows the results of the examination.

TABLE 1

| Direct-current resistance component R21 | Inductance component L21 | Degree of reduction in noise | Plug ignition performance | Durability of insulator |
|---|---|---|---|---|
| R21 > 1 Ω | L21 > 100 μH | Good | Poor | Good |
| R21 ≤ 1 Ω | L21 > 100 μH | Good | Poor | Good |
| R21 ≤ 1 Ω | 1 μH ≤ L21 ≤ 100 μH | Good | Good | Good |
| R21 ≤ 1 Ω | L21 < 1 μH | Poor | Good | Poor |

As shown in Table 1, in the case where the direct-current resistance component R21 was in excess of 1Ω, and the inductance component L21 was in excess of 100 μH, the degree of reduction in noise was excellent, but the plasma jet ignition plug 100 failed to exhibit high ignition performance. In the case where the direct-current resistance component R21 was 1Ω or less, and the inductance component L21 was in excess of 100 μH, the degree of reduction in noise was excellent, but the plasma jet ignition plug 100 failed to exhibit high ignition performance. In the case where the direct-current resistance component R21 is 1Ω or less, and the inductance component L21 was 1 μH to 100 μH inclusive, the degree of reduction in noise was excellent, and the plasma jet ignition plug 100 exhibited high ignition performance. In the case where the direct-current resistance component R21 was 1Ω or less, and the inductance component L21 was less than 1 μH, the plasma jet ignition plug 100 exhibited high ignition performance, but the degree of reduction in noise was poor. The examination has revealed that, in the case where the direct-current resistance component R21 is 1Ω or less, and the inductance component L21 is 1 μH to 100 μH inclusive, the degree of reduction in noise is excellent, and the plasma jet ignition plug 100 exhibits high ignition performance. By contrast, in the case where one or both of the direct-current resistance component R21 and the inductance component L21 fall outside the respective favorable ranges, the degree of reduction in noise is poor, or the plasma jet ignition plug 100 fails to exhibit excellent ignition performance. In the present invention, on the basis of the results of the examination, the thickness of wire and the number of turns of the wire-wound resistor 21 are determined such that the wire-wound resistor 21 has a direct-current resistance of 1Ω or less and an inductance of 1 μH to 100 μH inclusive.

FIG. 5 shows specific examples of waveforms of discharge current and discharge voltage applied to the plasma jet ignition plug 100. A discharge voltage V11 and a discharge current I11 shown at the right of FIG. 5 are of the plasma jet ignition plug 100 in which the wire-wound resistor 21 shown in FIG. 2 is incorporated. A discharge voltage V12 and a discharge current I12 shown at the left of FIG. 5 are of an ordinary plasma jet ignition plug in which the wire-wound resistor 21 is not incorporated.

As shown in FIG. 5, the discharge current I11 of the plasma jet ignition plug 100 in which the wire-wound resistor 21 is incorporated is smaller in amplitude than the discharge current I12 of the plasma jet ignition plug in which the wire-wound resistor 21 is not incorporated. That is, by virtue of provision of the wire-wound resistor 21 in the plasma jet ignition plug 100, high-frequency current which is derived from the stray capacitance C100 and flows at the time of "capacitive discharge" is restrained, so that noise is reduced.

Figure 11:
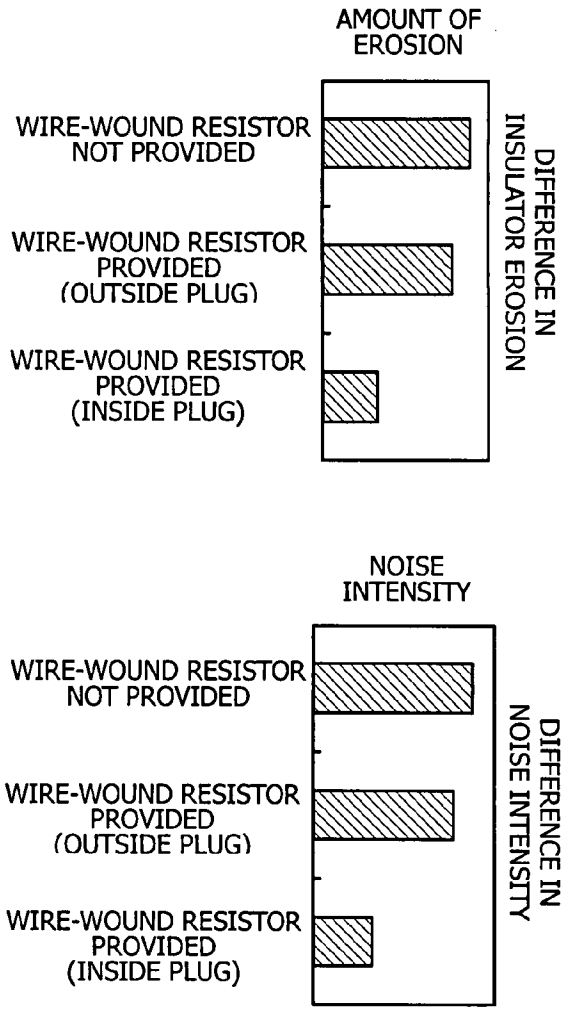
FIG. 11 are graphs showing the results of evaluation of characteristics of samples of the plasma jet ignition plug of the present invention.

The wire-wound resistor 21 yields an effect other than restraint of noise. Specifically, the provision of the wire-wound resistor 21 restrains erosion of insulator located in the vicinity of the cavity 60 at the time of discharge. FIG. 11 and Table 1 show the results of evaluation performed on samples of the plasma jet ignition plug 100. FIG. 11 shows evaluation results regarding insulator erosion and noise intensity. Table 1 shows the results of examination of the relationship between insulator erosion and the values of the direct-resistance component R21 and the inductance component L21. The evaluation results shown in FIG. 11 allow comparison of characteristics among the following cases: the wire-wound resistor 21 is incorporated; a wire-wound resistor is externally connected to the plasma jet ignition plug 100; and a wire-wound resistor is not provided. As is apparent from the evaluation results, in contrast to the case where a wire-wound resistor is not provided, the characteristics are improved in the case where the wire-wound resistor 21 is incorporated and the case where a wire-wound resistor is externally connected to the plasma jet ignition plug 100. As is apparent from Table 1, which shows the results of a detailed examination of the case where a wire-wound resistor is provided, in the case where the direct-current resistance component R21 is 1Ω or less, and the inductance component L21 is 1 μH to 100 μH inclusive, the degree of reduction in noise is excellent; the plasma jet ignition plug 100 exhibits high ignition performance; and erosion of insulator located in the vicinity of the cavity 60 is restrained, so that the insulator exhibits high durability.

Next, modifications of the above-described plasma jet ignition plug 100 will be described.

Figure 6A:
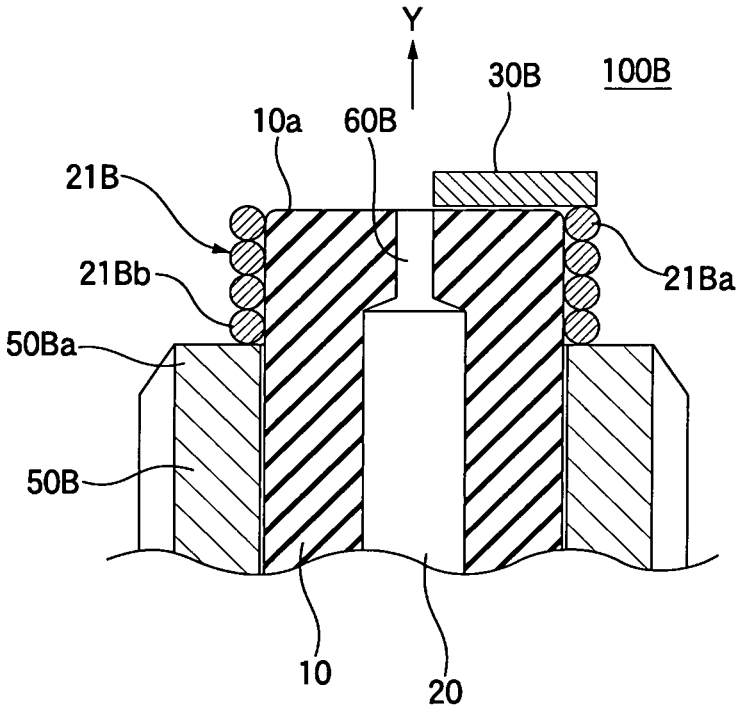
Figure 6B:
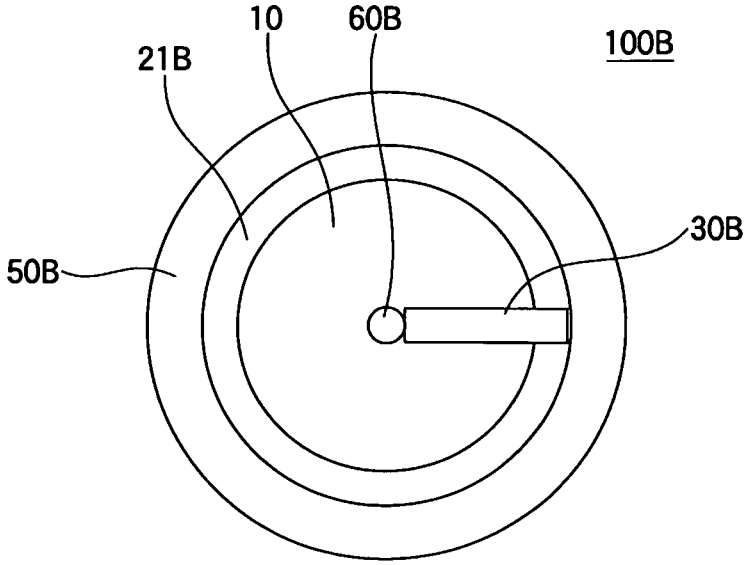

Modification 1:

FIG. 6A is a partial, sectional view showing a front end portion (corresponding to the region P in FIG. 2) of a plasma jet ignition plug 100B according to Modification 1, and FIG. 6B is a top view of the front end portion. Like elements in FIGS. 1 and 2 and FIGS. 6A and 6B are denoted by like reference numerals. Configurational features other than the elements shown in FIGS. 6A and 6B are identical with those of the plasma jet ignition plug 100 of FIG. 1.

In the plasma jet ignition plug 100B shown in FIGS. 6A and 6B, a wire-wound resistor 21B is provided at a position different from that in the plasma jet ignition plug 100 shown in FIG. 2. As shown in FIGS. 6A and 6B, a front end portion 50Ba of a metallic shell 50B is located rearward of a front end surface 10*a* of the insulator 10, and the front end surface 10*a* of the insulator 10 projects frontward (in the direction of the arrow Y) from the metallic shell 50B.

A conductive wire used to form the wire-wound resistor 21B is spirally wound onto the outer circumference of the projecting portion of the insulator 10. Similar to the wire-wound resistor 21, the wire-wound resistor 21B has a direct-current resistance of 1Ω or less and an inductance of 1 μH to 100 μH inclusive. One end 21Ba of the wire-wound resistor 21B is electrically connected to a ground electrode 30B assuming substantially the form of a straight bar. The one end 21Ba of the wire-wound resistor 21B is electrically connected to the ground electrode 30B by, for example, welding. The other end 21Bb of the wire-wound resistor 21B is electrically connected to the front end portion 50Ba of the metallic shell 50B. As shown in FIG. 6B, the ground electrode 30B is disposed such that one end is connected to the one end 21Ba of the wire-wound resistor 21B, while the other end is located in the vicinity of a cavity 60B and utilized for generating discharge in cooperation with the center electrode 20.

Figure 7:
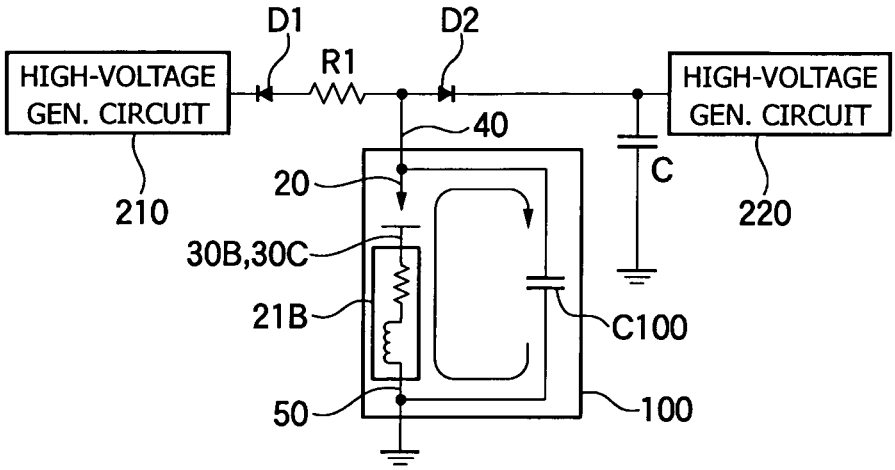
FIG. 7 is an electric circuit diagram showing the circuit configuration of an ignition system which includes an equivalent circuit of the interior of the plasma jet ignition plug according to Modification 1.

FIG. 7 shows the circuit configuration of an ignition system which includes an equivalent circuit of the interior of the plasma jet ignition plug 100B shown in FIGS. 6A and 6B. As shown in FIG. 7, the wire-wound resistor 21B is inserted between the metallic shell 50 and the ground electrode 30B, which is utilized for discharge.

Similar to the case of use of the plasma jet ignition plug 100 shown in FIG. 2, through use of the plasma jet ignition plug 100B having the wire-wound resistor 21B incorporated therein, the wire-wound resistor 21B restrains current derived from stray capacitance present in the plasma jet ignition plug 100B at the time of capacitive discharge, thereby reducing noise. In the case where the wire-wound resistor 21B is provided on the metallic shell 50 side as shown in FIGS. 6A and 6B, stray capacitance free from influence of the wire-wound resistor 21B reduces as compared with the configuration shown in FIG. 2, so that the effect of reducing noise is further enhanced.

Figure 8A:
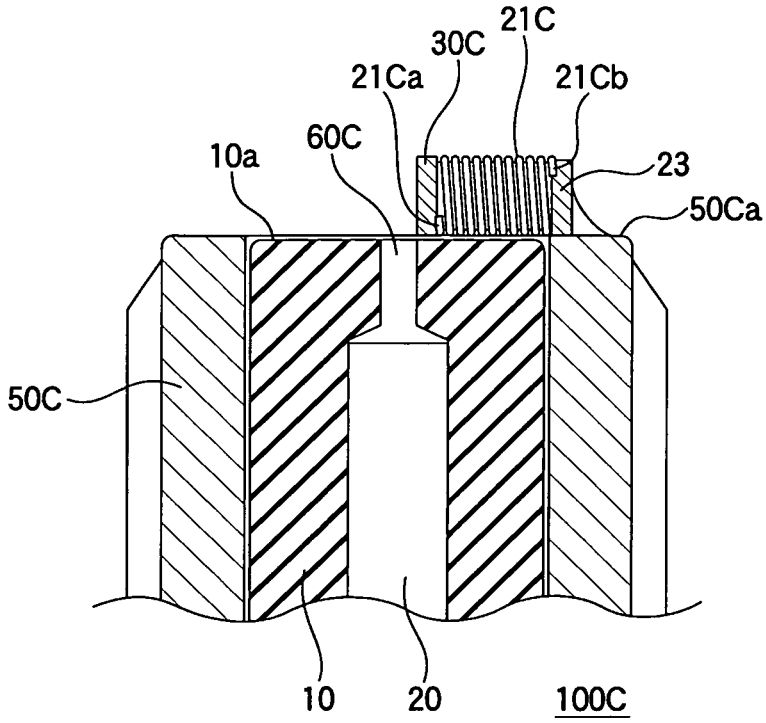
Figure 8B:
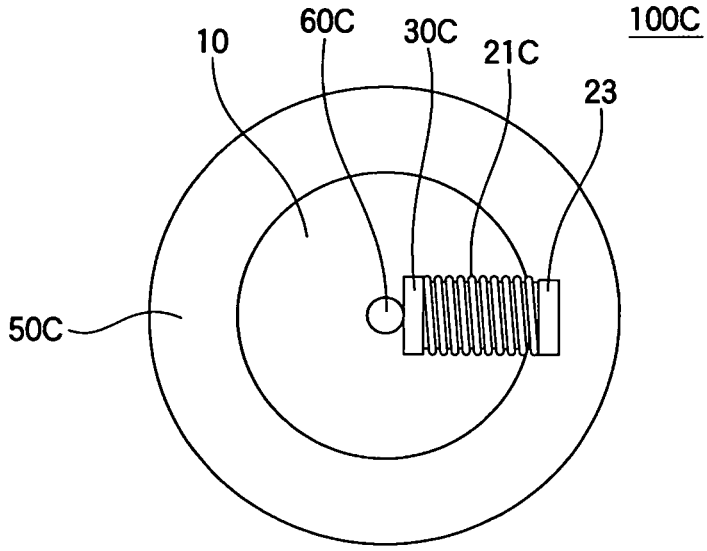

Modification 2:

FIG. 8A is a partial, sectional view showing a front end portion (corresponding to the region P in FIG. 2) of a plasma jet ignition plug 100C according to Modification 2, and FIG. 8B is a top view of the front end portion. Like elements in FIGS. 1 and 2 and FIGS. 8A and 8B are denoted by like reference numerals. Configurational features other than the elements shown in FIGS. 8A and 8B are identical with those of the plasma jet ignition plug 100 of FIG. 1.

In the plasma jet ignition plug 100C shown in FIGS. 8A and 8B, a wire-wound resistor 21C is provided at a position different from that in the plasma jet ignition plug 100 shown in FIG. 2. As shown in FIGS. 8A and 8B, the front end surface 10*a* of the insulator 10 and a front end surface 50Ca of a metallic shell 50C are located at substantially the same position. The wire-wound resistor 21C is disposed laterally (the axis thereof is perpendicular to the Y direction) in contact with the front end surface 10*a* of the insulator 10.

The wire-wound resistor 21C is configured such that a conductive wire is wound spirally onto a bobbin 23 formed from an electrically insulative material. Similar to the wire-wound resistor 21, the wire-wound resistor 21C has a direct-current resistance of 1Ω or less and an inductance of 1 μH to 100 μH inclusive. One end 21Ca of the wire-wound resistor 21C is electrically connected to a ground electrode 30C located at the position of one end portion of the bobbin 23. The other end portion 21Cb of the wire-wound resistor 21C is electrically connected to a conductor located at the position of the other end portion of the bobbin 23, thereby being electrically connected to the front end surface 50Ca of the metallic shell 50C via the conductor. The opposite ends 21Ca and 21Cb of the wire-wound resistor 21C are electrically connected by, for example, welding to the ground electrode 30C and the conductor, respectively, located at the respective end portions of the bobbin 23. The ground electrode 30C located at one end portion of the bobbin 23 is disposed in the vicinity of a cavity 60C and utilized for generating discharge in cooperation with the center electrode 20. An equivalent circuit of the interior of the plasma jet ignition plug 100C is similar to that shown in FIG. 7. That is, as shown in FIG. 7, the wire-wound resistor 21C is inserted between the metallic shell 50C and the ground electrode 30C, which is utilized for discharge.

Figure 9:
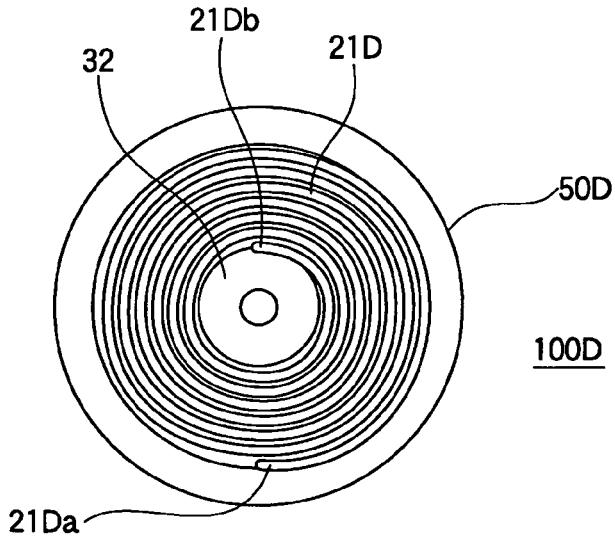
FIG. 9 is a plan view showing a front end portion of a plasma jet ignition plug according to Modification 4 as viewed from the front end side.
Figure 10:
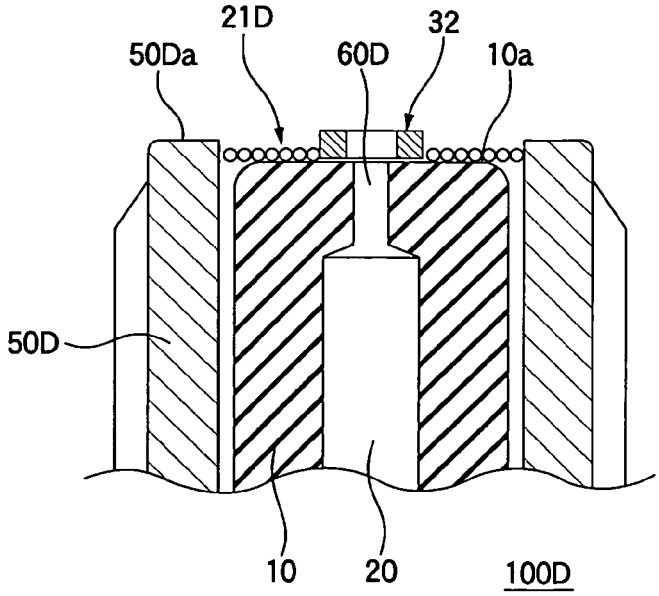
FIG. 10 is a partial, sectional view showing, on an enlarged scale, a portion of the plasma jet ignition plug according to Modification 4.

Modification 3:

FIGS. 9 and 10 show the configuration of a front end portion (corresponding to the region P in FIG. 2) of a plasma jet ignition plug 100D according to Modification 3. FIG. 9 is a plan view as viewed from the front end side of the plasma jet ignition plug 100D, and FIG. 10 is a partial, sectional view taken along the axial direction. Like elements in FIGS. 1 and 2 and FIGS. 9 and 10 are denoted by like reference numerals. Configurational features other than the elements shown in FIGS. 9 and 10 are identical with those of the plasma jet ignition plug 100 of FIG. 1.

In the plasma jet ignition plug 100D shown in FIGS. 9 and 10, a wire-wound resistor 21D is provided at a position different from that in the plasma jet ignition plug 100 shown in FIG. 2. As shown in FIG. 10, a front end surface 50Da of a metallic shell 50D projects frontward slightly from the front end surface 10*a* of the insulator 10. Accordingly, the front end surface 10*a* of the insulator 10 is recessed slightly from the front end surface 50Da of the metallic shell 50D. The wire-wound resistor 21D is disposed in the recess. An electrode chip 32 (corresponding to a ground electrode) formed from a conductive metal material is disposed at a position which faces a central portion of the front end surface 10*a* of the insulator 10. The electrode chip 32 has the opening portion 14 formed at a central portion; i.e., at a position which faces a cavity 60D.

As shown in FIGS. 9 and 10, the wire-wound resistor 21D is configured such that a conductive wire is wound spirally around the electrode chip 32. The wire used to form the wire-wound resistor 21D is covered with electrically insulative coating. Similar to the wire-wound resistor 21, the wire-wound resistor 21D has a direct-current resistance of 1Ω or less and an inductance of 1 μH to 100 μH inclusive. An outer end 21Da of the wire-wound resistor 21D is electrically connected to the metallic shell 50D, and an inner end 21Db of the wire-wound resistor 21D is electrically connected to the electrode chip 32. In the plasma jet ignition plug 100D, high voltage applied between the center electrode 20 and the electrode chip 32 generates discharges therebetween. An equivalent circuit of the interior of the plasma jet ignition plug 100D is similar to that shown in FIG. 7 except that the one end 21Ba of the wire-wound resistor 21B is replaced with the electrode chip 32.

Conceivably, the above-mentioned wire-wound resistors 21, 21B, 21C, and 21D are disposed on either the center electrode 20 side or the metallic shell 50 side, or on both sides. By means of the wire-wound resistor 21 being disposed on at least one of the center electrode 20 side and the metallic shell 50 side, there can be controlled the amplitude of current derived from stray capacitance present in the plasma jet ignition plug and the period of time when the current flows; radiated noise can be reduced; and insulator erosion and electrode erosion can be restrained.

Description of Reference Numerals

| | |
|---|---|
| 4: | seal body |
| 5: | gasket |
| 10: | insulator |
| 12: | axial hole |
| 13: | leg portion |
| 14: | opening portion |
| 15: | electrode-accommodating portion |
| 16: | front end surface |
| 17: | front trunk portion |
| 18: | rear trunk portion |
| 19: | intermediate trunk portion |
| 20: | center electrode |
| 21, 21B, 21C, 21D: | wire-wound resistor |
| 22, 23: | bobbin |
| 25: | electrode chip |
| 30, 30B, 30C: | ground electrode |
| 31: | communication hole |
| 32: | electrode chip |
| 40: | metal terminal |
| 50, 50B, 50C, 50D: | metallic shell |
| 52: | mounting threaded portion |
| 60, 60B, 60C, 60D: | cavity |
| 100: | plasma jet ignition plug |
| 200: | ignition system |
| 210, 220: | high-voltage generation circuit |
| 211: | ignition coil |
| 230: | direct-current power supply |
| 300: | engine head |

Having described the invention, the following is claimed:

1. A plasma jet ignition plug comprising:

an insulator having an axial hole extending in an axial direction, a center electrode disposed within the axial hole of the insulator, a substantially tubular metallic shell disposed radially outward of the insulator, a ground electrode defining a spark discharge gap in cooperation with the center electrode, wherein a front end of the center electrode is located rearward of a front end of the insulator with respect to the ground electrode, and a resistor incorporated into a front end portion of the plasma jet ignition plug, said resistor electrically connected to at least one of the center electrode and the ground electrode and having an inductance of 1 μH to 100 μH inclusive and a resistance of 1Ω or less, but greater than 0Ω.

2. A plasma jet ignition plug according to claim 1, wherein the resistor is provided while being connected to a rear end portion of the center electrode.

3. A plasma jet ignition plug according to claim 1, wherein the resistor is provided such that one end of the resistor is connected to the ground electrode, and the other end of the resistor is connected to the metallic shell.

* * * * *